US009051779B2

(12) United States Patent
Kerr

(10) Patent No.: US 9,051,779 B2
(45) Date of Patent: Jun. 9, 2015

(54) DUAL TRACK LADDER FOR USE WITH MOBILE SHELVING

(71) Applicant: James F. Kerr, Croswell, MI (US)

(72) Inventor: James F. Kerr, Croswell, MI (US)

(73) Assignee: Material Control, Inc., Croswell, MI (US)

( * ) Notice: Subject to any disclaimer, the term of this patent is extended or adjusted under 35 U.S.C. 154(b) by 0 days.

(21) Appl. No.: 13/669,869

(22) Filed: Nov. 6, 2012

(65) Prior Publication Data

US 2013/0248285 A1 Sep. 26, 2013

Related U.S. Application Data

(60) Provisional application No. 61/614,859, filed on Mar. 23, 2012.

(51) Int. Cl.

| | |
|---|---|
| ***E04G 3/28*** | (2006.01) |
| ***E06C 9/12*** | (2006.01) |
| *E06C 1/39* | (2006.01) |
| *E06C 7/18* | (2006.01) |

(52) U.S. Cl.

CPC ... *E06C 9/12* (2013.01); *E06C 1/39* (2013.01); *E06C 7/183* (2013.01)

(58) Field of Classification Search

CPC ..... E06C 9/12

USPC ..... 182/36, 38, 39, 62, 62.5, 68.1, 86, 104, 182/186.3

See application file for complete search history.

(56) References Cited

U.S. PATENT DOCUMENTS

| | | | | | |
|---|---|---|---|---|---|
| 423,962 | A | * | 3/1890 | Smith | 182/13 |
| 476,564 | A | * | 6/1892 | Sincennes | 182/38 |
| 508,099 | A | * | 11/1893 | Fisher | 182/39 |
| 528,824 | A | * | 11/1894 | Summer | 182/39 |
| 888,383 | A | * | 5/1908 | Asoh | 182/39 |
| 907,401 | A | * | 12/1908 | Prouty | 182/39 |
| 1,090,803 | A | * | 3/1914 | Brown | 182/39 |
| 1,411,438 | A | * | 4/1922 | Kalkusch | 182/86 |
| 1,945,531 | A | * | 2/1934 | Kramer | 182/1 |

(Continued)

FOREIGN PATENT DOCUMENTS

EP 1 947 033 A1 7/2008

OTHER PUBLICATIONS

Nucor Building Systems, Automated Steel Framing Systems [online] [retrieved on Jul. 9, 2013]. Retrieved from the internet: <URL: http://www.nbslgt.com/>.

(Continued)

*Primary Examiner* — Katherine Mitchell
*Assistant Examiner* — Candace L Bradford
(74) *Attorney, Agent, or Firm* — Dykema Gossett PLLC

(57) ABSTRACT

A ladder assembly for use with movable shelving is disclosed. The ladder assembly may comprise an overhead track assembly, a carriage, and a ladder. The overhead track assembly includes a first guide track and a second guide track. The carriage is operatively configured to move longitudinally along the first and second guide tracks. The ladder is pivotally and slidably mounted to the carriage. The ladder has an operating position and a stored position. The operating position is located in an open available aisle of the movable shelving. The stored position may be located substantially vertical and outside of the aisle of the movable shelving allowing the movable shelving to close the aisle without interference from the ladder.

7 Claims, 8 Drawing Sheets

(56) References Cited

U.S. PATENT DOCUMENTS

| | | | | | |
|---|---|---|---|---|---|
| 2,273,124 | A * | 2/1942 | McDaniels | 182/39 |
| 4,084,125 | A | 4/1978 | King | |
| 4,227,466 | A | 10/1980 | Rooklyn | |
| 4,991,725 | A | 2/1991 | Welsch et al. | |
| 5,072,838 | A | 12/1991 | Price, Jr. et al. | |
| 5,154,305 | A | 10/1992 | Whitney | |
| 5,333,983 | A * | 8/1994 | Hatouchi et al. | 414/331.06 |
| 5,411,112 | A * | 5/1995 | Jephcott | 182/84 |
| 5,413,191 | A * | 5/1995 | Kerr | 182/39 |
| 5,680,942 | A * | 10/1997 | McAllister et al. | 211/162 |
| 5,842,585 | A | 12/1998 | Hollander | |
| 5,860,784 | A | 1/1999 | Schuitema et al. | |
| 5,878,836 | A * | 3/1999 | Huang | 182/86 |
| 5,967,346 | A | 10/1999 | Price, Jr. | |
| 6,325,586 | B1 | 12/2001 | Loy | |
| 6,464,092 | B1 | 10/2002 | Kortman et al. | |
| 6,471,309 | B1 * | 10/2002 | Turner | 312/201 |
| 6,550,403 | B2 | 4/2003 | Dressendorfer et al. | |
| 6,581,876 | B2 * | 6/2003 | Cheung | 244/118.5 |
| 6,688,708 | B1 | 2/2004 | Janson | |
| 6,948,622 | B2 | 9/2005 | Brownfield et al. | |
| 7,757,813 | B2 * | 7/2010 | Kerr | 182/39 |
| 2001/0037914 | A1 * | 11/2001 | Preusser et al. | 182/150 |
| 2003/0094884 | A1 | 5/2003 | Sobol | |
| 2012/0292130 | A1 * | 11/2012 | Larson | 182/39 |

OTHER PUBLICATIONS

TrusSteel, a division of ITW Building Components Group, Truss Design Manual [online] [retrieved on Jul. 9, 2013]. Retrieved from the internet: <URL: http//www.trussteel.com/index.php>.

VanderWal—Cold-Formed Floor Connection [online] [retrieved on Jul. 9, 2013]. Retrieved from the internet: <URL: http://www.trusses.ca/images/stories/downloads/Floor%20Details/Floor%20Details%20-%20Cold-Formed%20Joist%20System.pdf>.

Weyerhauser—Product Overview: TJI Joists [online] [retrieved on Jul. 9, 2013]. Retrieved from the internet: <URL: http://www.woodbywy.com/products/trus-joist/tji-joists/>.

Wikipedia—I-joist [online] [retrieved on Jul. 9, 2013]. Retrieved from the internet: <URL: http://en.wikipedia.org/wiki/I-joist>.

Wikipedia—Glued Laminated Timber (Glulams a/k/a LVLs) [online] [retrieved on Jul. 9, 2013]. Retrieved from the internet: <URL: http://en.wikipedia.org/wiki/Glued_laminated_timber>.

Boise Cascade—Boise Glulam [online] [retrieved on Jul. 9, 2013]. Retrieved from the internet: <URL: http://www.bc.com/wood/ewp/simpleFraming/glulam.html>.

Georgia-Pacific—GP Lam Laminated Veneer Lumber (LVL) [online] [retrieved on Jul. 9, 2013]. Retrieved from the internet: <URL: http://www.gp.com/build/product.aspx?pid=1392>.

Metwood Building Solutions—Light Gauge Metal Floorspan [online] [retrieved on Jul. 9, 2013]. Retrieved from the internet: <URL: http://www.metwood.com/products/floorspan>.

VanderWal—Cold-Formed Metal Trusses [online] [retrieved on Jul. 9, 2013]. Retrieved from the internet: <URL: http://www.trusses.ca/images/stories/downloads/Specifications/Specification%20-%20Section%2005%2044%2000%20-%20Cold-Formed%20Metal%20Trusses.pdf>.

Fermco—Prefabricated Floor Joists [online] [retrieved on Jul. 9, 2013]. Retrieved from the internet: <URL: http://www.fermco.com/>.

SpaceJoist [online] [retrieved on Jul. 9, 2013]. Retrieved from the internet: <URL: http://www.spacejoist.com/dealers.php>.

Cemco Steel Framing and Metal Lath [online] [retrieved on Jul. 9, 2013]. Retrieved from the internet: <URL: http://www.cemcosteel.com>.

Nascor by Kott [online] [retrieved on Jul. 9, 2013]. Retrieved from the internet: <URL: http://nascor.ca/home/>.

Weyerhauser Trus Joist—Engineered Wood Products, Technical Bulletin TB-203, Attaching Fire Sprinkler Components to Trus Joist Engineered Wood Products, Dec. 2011.

Weyerhauser Trus Joist—Engineered Wood Products, #1500 Design/Istallation Guide, Fire-Rated Assemblies and Sprinkler Systems.

Aegis Metal Framing [online] [retrieved on Jul. 10, 2013]. Retrieved from the internet: <URL: http://www.aegismetalframing.com/>.

* cited by examiner

DUAL TRACK LADDER FOR USE WITH MOBILE SHELVING

CROSS-REFERENCE TO RELATED APPLICATIONS

This application claims the benefit of U.S. provisional application No. 61/614,859, filed Mar. 23, 2012, which is hereby incorporated by reference as though fully set forth herein.

BACKGROUND a. Field of the Disclosure

The instant disclosure relates generally to ladder apparatuses and systems.

b. Background Art

As is well-known in the art, mobile shelving, also known as high density shelving, may comprise a plurality of storage shelves arranged in a bank of shelves. The storage shelves may move along a track in a subfloor or integrated with the flooring of the building. One or more of the shelves in the bank of shelves can be moved along the track to create an aisle between any two adjacent shelves in the bank, while also eliminating or substantially limiting the space between the other shelves in the bank. The aisle may be effectively moved within the bank of shelves to provide access to any two adjacent shelves therein by moving one or more respective or corresponding shelves in the shelve bank.

As the storage shelves become taller, operator access to the upper regions of the shelves may require a ladder. However, for mobile shelving where the available aisle varies, it may be necessary to remove the ladder from the current aisle after use in order to compress the current aisle to expose a different aisle.

BRIEF SUMMARY

It may be desirable to have a ladder system that accommodates accessibility to a ladder that is easily configured to move in and out of the currently available aisle of mobile shelving.

In an embodiment, a ladder assembly for use with movable shelving may comprise an overhead track assembly, a carriage, and a ladder. The overhead track assembly includes a first guide track and a second guide track. The carriage is operatively configured to move longitudinally along the first and second guide tracks. The ladder is pivotally and slidably mounted to the carriage. The ladder has an operating position and a stored position. The ladder in the operating position is located in an open available aisle of the movable shelving. The ladder in the stored position may be located outside of the aisle of the movable shelving, and may be disposed in a substantially vertical orientation, thereby allowing the movable shelving to close the aisle without interference from the ladder.

In an embodiment, a ladder system for use with movable shelving may comprise a ladder assembly and a plurality of mounting brackets. The ladder assembly may comprise an overhead track assembly, a carriage, and a ladder. The overhead track assembly includes a first guide track and a second guide track. The carriage may have a roller set, where each carriage is operatively configured to move longitudinally along said first and second guide tracks via the roller set. The ladder is pivotally and slidably mounted to the carriage. The ladder has an operating position and a stored position. The ladder in the operating position is located in an open available aisle of the movable shelving. The ladder in the stored position may be located outside of the aisle of the movable shelving, and may be disposed in a substantially vertical orientation, thereby allowing the movable shelving to close the aisle without interference from the ladder. The plurality of mounting brackets may be configured to connect the overhead track assembly to an overhead support structure. A portion of the mounting brackets may form a portion of said first and second guide tracks.

The foregoing and other aspects, features, details, utilities, and advantages of the present disclosure will be apparent from reading the following description and claims, and from reviewing the accompanying drawings.

DETAILED DESCRIPTION

Figure 1:
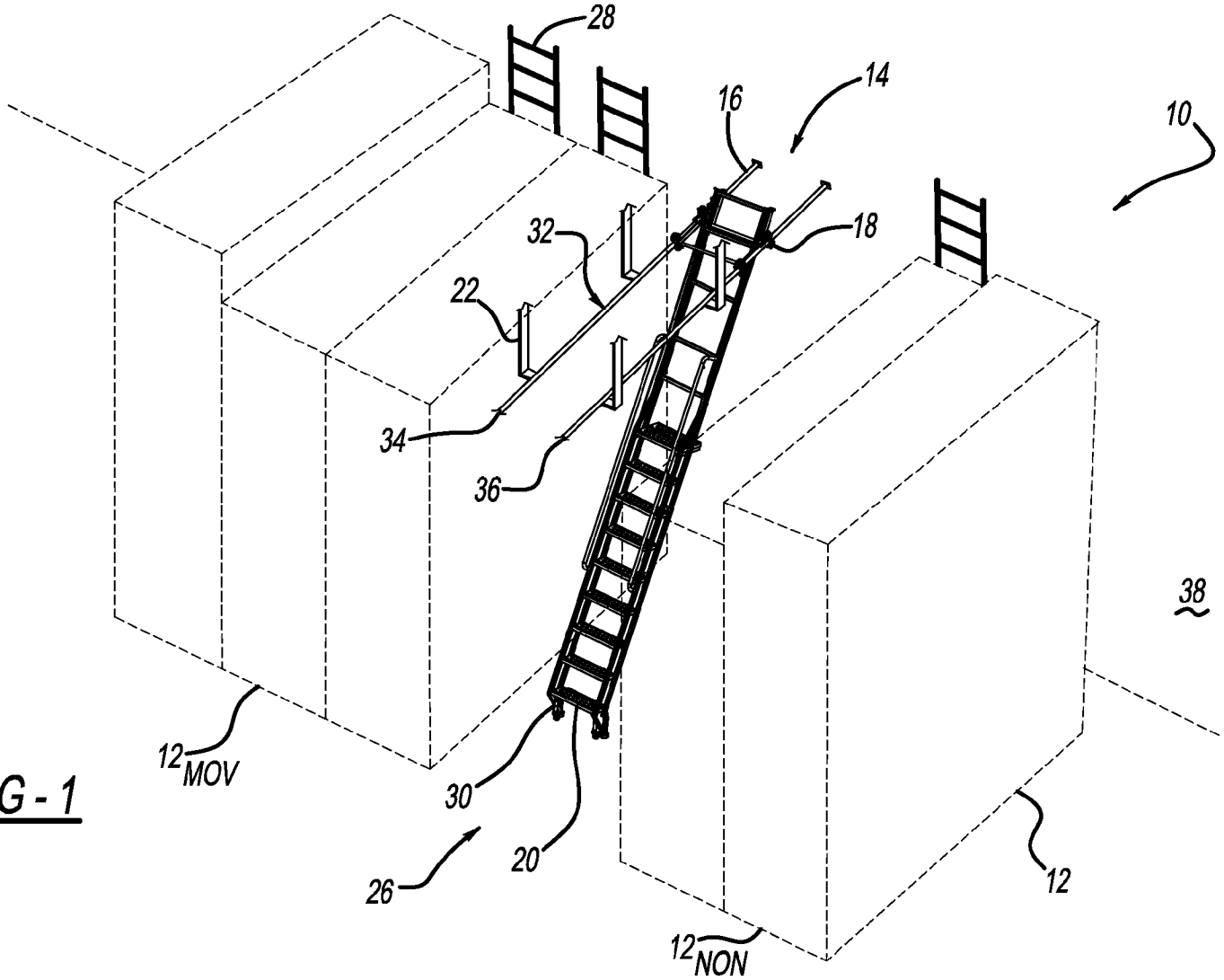
FIG. 1 is an isometric view of an embodiment of a ladder system having a plurality of ladder assemblies that may be used with mobile shelving.

Referring to the drawings appended hereto and the description below, FIG. 1 generally illustrates a partial isometric view of an exemplary embodiment of a ladder system 10 that may be used with high density, movable, or mobile shelving 12. The ladder system 10 may comprise a ladder assembly 14 including an overhead track assembly 16, a carriage 18, a ladder 20, and a plurality of mounting brackets 22 configured to connect the overhead track assembly 16 to a support structure 24 (as seen in FIG. 2).

Each ladder assembly 14 may be aligned relative to an aisle 26 that may be created as the mobile shelving is moved. As used herein, an aisle 26 may generally refer to the space created between adjacent shelves where the aisle 26 length is about the longitudinal length of the movable aisles 26. For example, and without limitation, a mobile shelving bank 12 may be capable of having four aisles 26. In such an embodiment, four ladder assemblies 14 may be provided, one for each of the four aisles 26. When the aisles 26 are unavailable due to the substantially reduced or eliminated space between the shelves 12, a respective ladder 20 of the ladder assembly 14 corresponding with those aisles 26 are placed in a stored position 28. The stored position 28 moves the ladder assembly 14 outside of the aisle 26, or in other words, outside of the moving path of the movable shelves $\mathbf{12}_{MOV}$. As the aisle 26 becomes available, the respective ladder 20 associated with that aisle 26 may be moved into the available space of the aisle 26 and into an operating position 30. If another aisle 26 is desired, the ladder 20 in the operating position 30 is moved to the stored position 28. The mobile shelving 12 may then be configured to the new desired aisle 26 and the respective ladder 20 corresponding with the new desired aisle 26 may be placed in the operating position 30.

While FIG. 1 and the above description provides an exemplary embodiment having four ladder assemblies 14 to accommodate four aisles 26 in a mobile shelving bank 12, it will be appreciated that the present disclosure is not meant to be so limited. Rather, other exemplary embodiments may use any number of ladder assemblies 14 to accommodate any number of potential aisles 26 in a mobile shelving bank 12. Accordingly, it will be appreciated that embodiments other than those described with particularity herein remain within the spirit and scope of the present disclosure. For purposes of illustration and clarity, the present disclosure will refer to one ladder assembly 14 configured for use with one aisle as described below. Additionally, as used herein, the term "longitudinal direction" is defined as extending parallel to the laterally spaced apart storage shelves. The term "lateral direction" is defined as extending laterally between the storage shelves. An upward direction is defined as extending away from the ground and a downward direction is defined as extending toward the ground.

Figure 2:
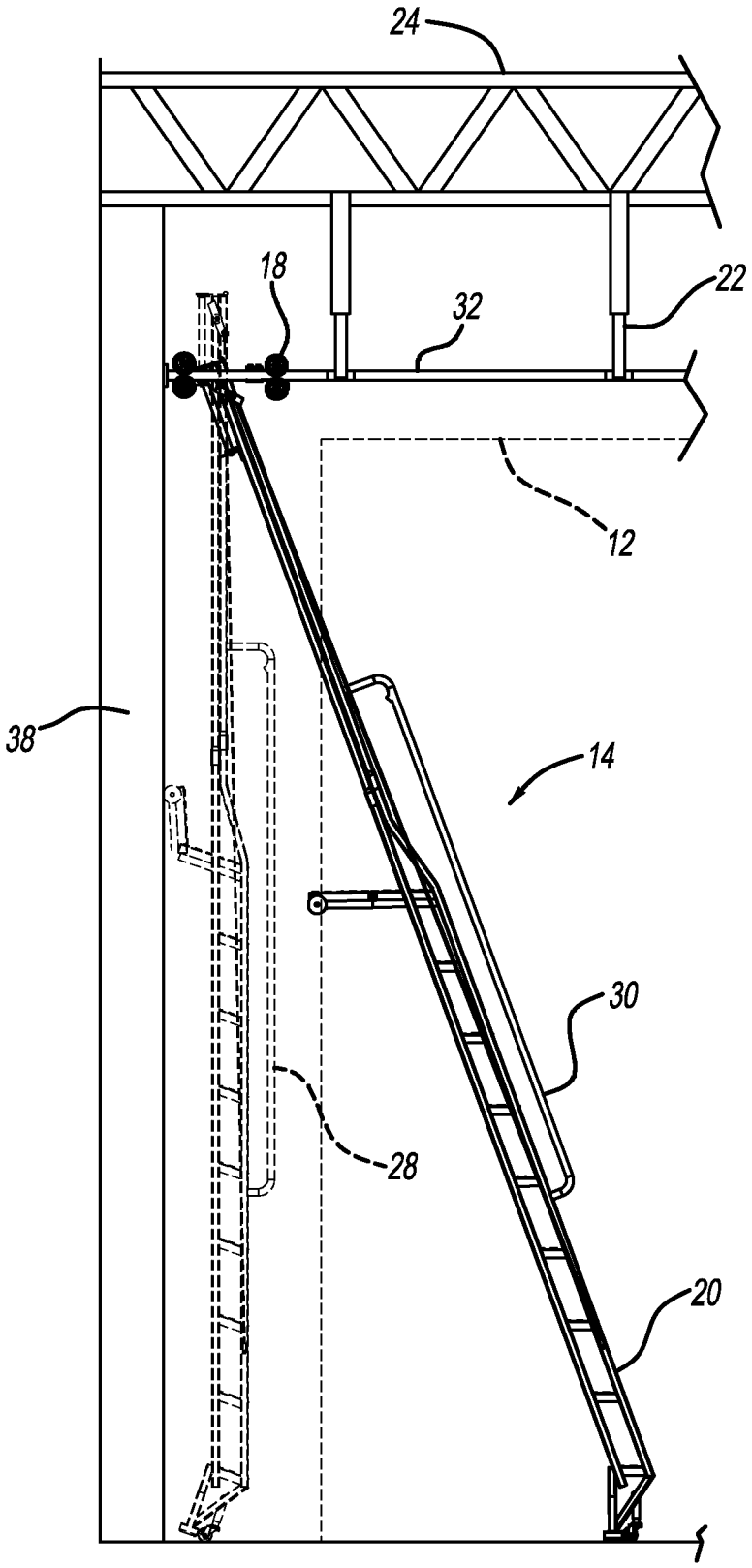
FIG. 2 is a partial side view of one of the ladder assemblies of the ladder system of FIG. 1 generally illustrating the ladder in an operating position and a stored position.
Figure 3A:
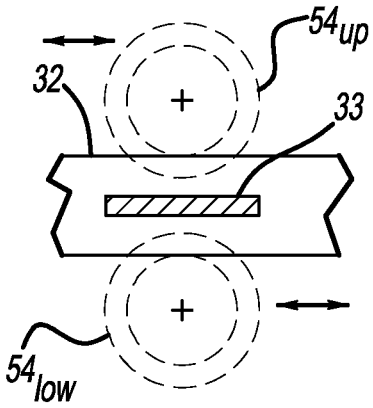
FIG. 3A is a partial cross sectional side view of a mounting bracket relative to a roller set of an overhead roller carriage along lines 3A-3A.
Figure 3:
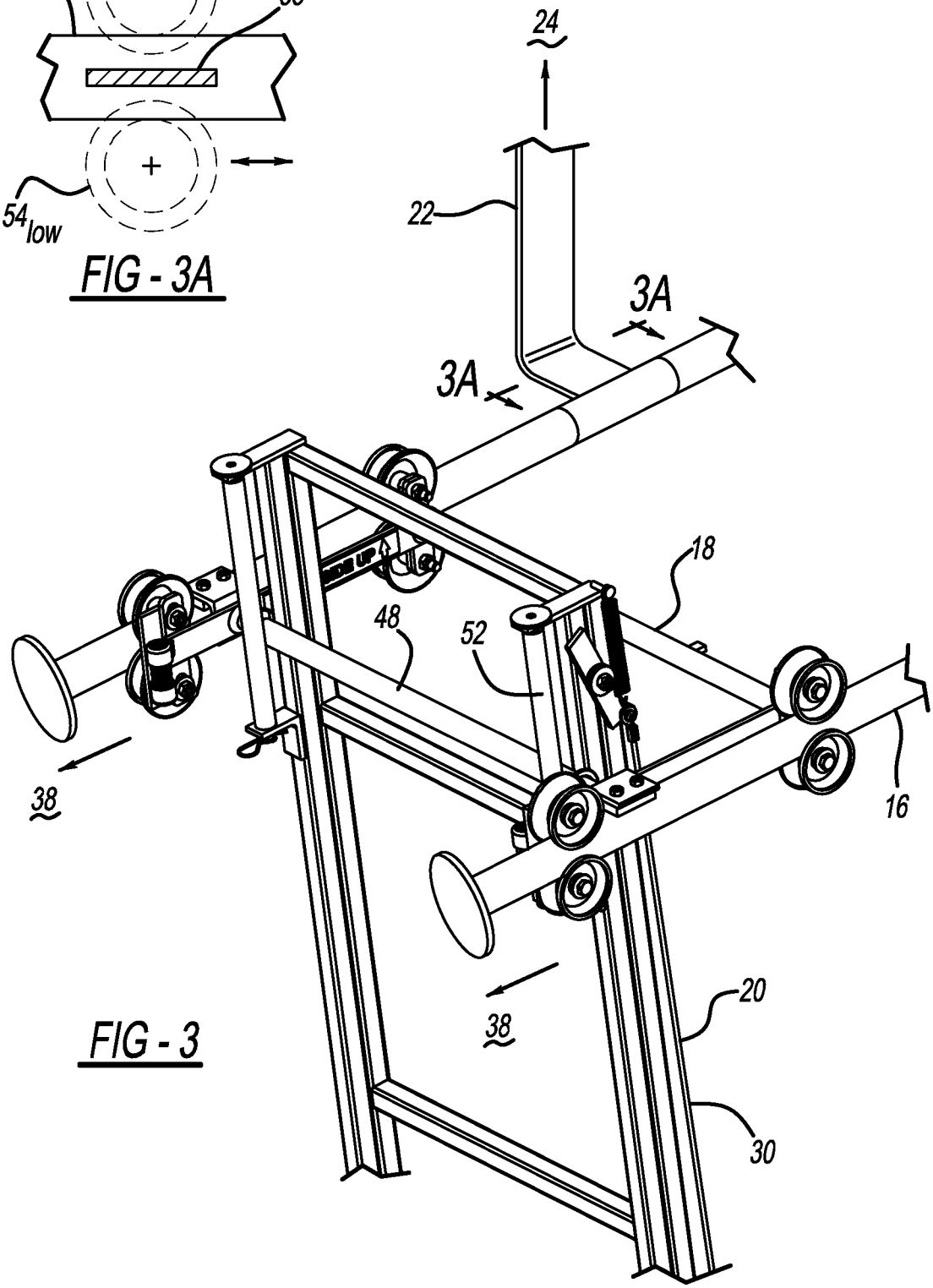
FIG. 3 is a partial isometric view of an upper portion of the ladder assembly and a portion of a mounting bracket of the ladder system.

As seen in FIGS. 1, 2, and 3, the ladder assembly 14 includes an overhead track assembly 16. FIG. 2 generally illustrates a partial side view of the ladder system 10 showing the ladder 20 in the operating position 30 and the stored position 28. FIG. 3 generally illustrates a partial isometric view of an upper portion of the ladder assembly 14.

In an embodiment, the overhead track assembly 16 includes a pair of tracks 32 (or dual tracks or dual rails), including a first overhead guide track 34 and a second overhead guide track 36. The dual tracks 32 are mounted above an aisle 26 created by the space between two adjacent storage shelves of the movable shelving 12. The dual tracks 32 are mounted at a height greater than the two adjacent storage shelves (i.e., on each side of the subject aisle) to allow clearance for the movement of the shelves during reconfiguration of the mobile shelving system 12. The dual tracks 32 are oriented substantially parallel to the aisle 26. The dual tracks 32 may be attached to the support structure 24, such as an overhead truss system, by the plurality of longitudinally spaced brackets 22. The brackets 22 may have a support portion and a connector portion. The support portion may be generally L-shaped. One leg (i.e., the vertically-oriented leg in FIG. 3) of the support portion is configured to attach to the overhead support structure 24. The other leg (i.e., the horizontally-oriented leg in FIG. 3) is attached to the connector portion of bracket 22 and may horizontally protrude from the connector portion. This allows the top and bottom surfaces of the connector to be free on any obstructions, allowing the roller carriage 18 (described in further detail below) to freely move on the dual tracks 32 without any encumbrances, as shown in FIG. 3A. Additionally, one end of the dual tracks 32 may be attached directly or indirectly to a wall 38. In another exemplary embodiment, the dual tracks 32 may be attached to the support structure 24, such as a plurality of laterally oriented support beams or trusses (e.g., trusses that are oriented substantially perpendicular to the aisles 26 attached and supported by a top surface of nonmovable shelves $\mathbf{12}_{NON}$ of the mobile shelving 12. The nonmovable shelves may be located at the ends of the mobile shelving 12 with the movable shelves $\mathbf{12}_{MOV}$ located between the nonmovable shelves $\mathbf{12}_{NON}$. The nonmovable shelves $\mathbf{12}_{NON}$ may be taller than the movable shelves $\mathbf{12}_{MOV}$ which may provide clearance for the overhead track assembly 16 that may be hanging above the movable shelves $\mathbf{12}_{MOV}$.

Figure 4:
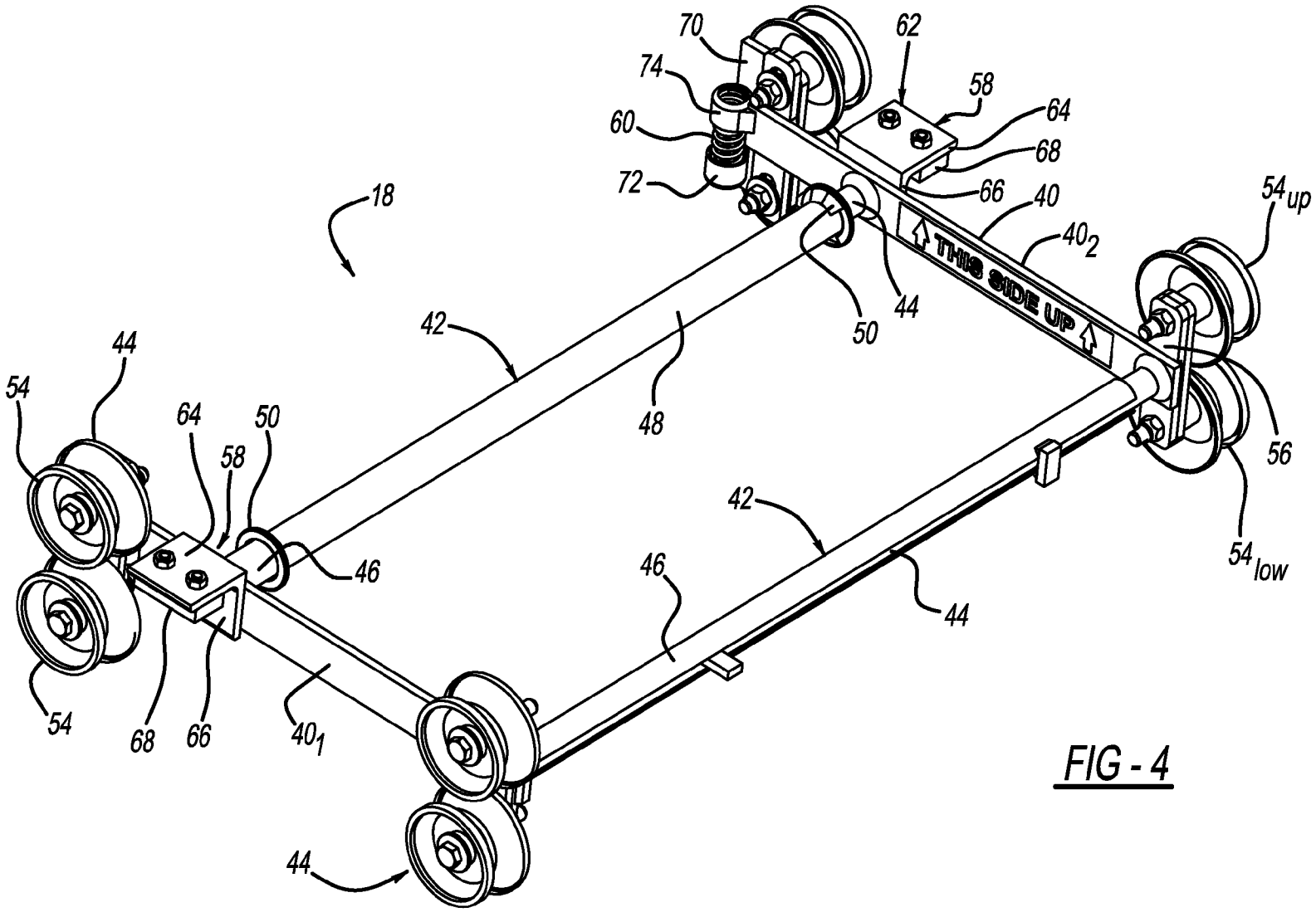
FIG. 4 is an isometric view of an embodiment of an overhead roller carriage of the ladder assembly.

Referring to FIGS. 3 and 4, an embodiment of the ladder assembly 14 is generally illustrated. FIG. 3 illustrates an overhead roller carriage 18 operably connected to the overhead track assembly 16. FIG. 4 illustrates an isometric view of an embodiment of the overhead roller carriage 18. The overhead roller carriage 18 moves longitudinally along the overhead track assembly 16 and supports the upper portion of the ladder 20. The carriage 18 allows the ladder 20 to move along the aisle 26 while locating and supporting the ladder 20. An embodiment of the overhead roller carriage 18 is disclosed in commonly owned U.S. Pat. No. 7,757,813, hereby incorporated by reference as though fully set forth herein. It should be understood that variations are possible. For example, in an embodiment, the overhead roller carriage 18 may comprise a pair of side walls 40, at least one support rod 42 located between the pair of side walls, and two pairs of roller sets 44 attached on each side wall 40, where the roller sets 44 are configured to mount onto the guide tracks 32.

The pair of side walls or side members 40 of the roller carriage 18 are laterally spaced apart and are parallel to one another. The pair of side walls 40 may be positioned adjacent to the dual tracks 32 where one side wall $\mathbf{40}_1$ is adjacent to one track 34 of the dual tracks 32 and the other side wall $\mathbf{40}_2$ is adjacent to the other track 36 of the dual tracks 32. The pair of side walls 40 may be connected to each other via the support rod 42. In an exemplary embodiment, the support rod 42 may be telescopically adjustable. The telescopically adjustable support rod 42 includes a pair of members, with an inner member 44 extending laterally from a side wall $\mathbf{40}_2$ toward the opposing side wall $\mathbf{40}_1$ and being slidable within an outer member 46 extending laterally from the side wall $\mathbf{40}_1$ toward the opposing side wall $\mathbf{40}_2$. The members 44, 46 are provided at the ends thereof with means for securing the adjustable support rod 42 to the side walls in order to fit or to adjust to the spacing between the laterally spaced apart shelves and any variation in the guide tracks or rails 32 (i.e., the spacing between the side walls 40 of the carriage 18 may be increased or decreased depending on, for example, the size of the aisle 26 and the distance between the two guide tracks 32). In an embodiment, the support rod 42 may be generally tubular in cross-sectional shape. While the present disclosure has been with respect to embodiment wherein the support rod 42 comprises a tubular cross-sectional shape, the present disclosure is not meant to be so limited. Rather, in other exemplary embodiments, other various cross-sectional shapes for the support rod 42 may be used as known to those having ordinary skill in the art. Accordingly, it will be appreciated that embodiments other than those described with particularity herein remain within the spirit and scope of the present disclosure.

In another exemplary embodiment, the roller carriage 18 may include a plurality of support rods 42 located between the pair of side walls 40, such as, but not limited to, a pair of support rods 42. In such an embodiment, a second support rod 42 may also include a pair of members, with an inner member 44 extending laterally from a side wall $\mathbf{40}_2$ toward the opposing side wall $\mathbf{40}_1$ and being slidable within an outer member 46 extending laterally from the side wall $\mathbf{40}_1$ toward the opposing side wall $\mathbf{40}_2$. While the present disclosure has been with respect to embodiments wherein the roller carriage 18 has one or two support rods 42, the present disclosure is not meant to be so limited. Rather, it will be appreciated by those having ordinary skill in the art that the roller carriage may have any number of support rods 42, and thus, embodiments wherein the roller carriage 18 has two or more support rods remain within the spirit and scope of the present disclosure.

At least one of the support rods 18 is configured as a mounting bar 48 for engagement with the ladder 20. The support rod 42 that is configured as the mounting bar 48 has a pair of shoulders or protrusions 50, one disposed at each end thereof The shoulders or protrusions 50 on the mounting bar 48 are configured to locate a sliding mechanism 52 (described in further detail below) on the ladder 20 relative to the roller carriage 18.

Each longitudinal end of each side wall 40 of the roller carriage 18 has mounted thereon a pair of roller sets 44, thereby providing two pairs of rollers 54 on each side wall 40. The rollers 54 are movable along respective guide tracks 32. The roller carriage 18 is mounted for movement in the longitudinal direction parallel to, and between, the shelves.

Each roller set 44 (for a total of 4, in an exemplary embodiment) has a respective bracket 56 attached to one of the side walls 40. Mounted on each bracket 56 is an upper roller $\mathbf{54}_{up}$ and a lower roller $\mathbf{54}_{low}$. Two pairs of roller sets 44 are carried on each of the side walls 40 and each of the rollers 54 thereof has an annular curved surface which is configured to receive or be engaged with a respective one of the dual guide tracks 32. In an exemplary embodiment, the guide tracks 32 are of circular cross-section.

The roller carriage 18 further includes a pair of brake mechanisms 58 and a pair of compression springs 60 corresponding thereto. Each brake mechanism 58 includes an L-shaped bracket 62 (in cross section) having a first leg 64 and a second leg 66 perpendicular to the first leg 64. A brake pad 68 may be made from rubber or other compressible material and is secured to the underside of the first leg 64 by means of one or more fastening devices, such as, for example and without limitation, nuts and bolts. The second leg 66 of each bracket 58 may be welded to the outer side or surface of a respective side wall 40. In an exemplary embodiment, one braking mechanism 58 is connected to each of the side walls 40 and the brake pad 68 thereof overlies and is engageable with a corresponding one of the first and second guide tracks 34, 36 when subjected to a sufficient load (e.g., that of a person) on the ladder 20 during use. This prevents movement of the ladder 20 at the top thereof in the longitudinal direction when a force is applied by a worker, for example, whether intentionally or unintentionally.

A side plate 70 is located adjacent one of the roller sets 44 near one end of each side wall 40. The side plate 70 may be connected to the roller set 44, where the side plate 70 is located between the bracket 56 and rollers 54 of the roller set 44. Each side plate 70 is provided with a lower spring cup 72. An upper spring cup 74 is welded or secured to the end of the side wall 40 and is located directly above (i.e., vertically aligned) and spaced apart from the lower spring cup 72. A compression spring 60 has opposite end portions received in the opposing upper and lower cups 72, 74. As mentioned previously, when a user/operator applies a force to the ladder, the upper braking mechanisms 58 are applied urging the brake pads 68 into engagement with the dual tracks 32 while simultaneously compressing the compression springs 60. When the user/operator removes himself from the ladder, the force applied to the compression springs 60 is removed, allowing the compression springs 60 to decompress (e.g., spring back toward the compression spring's 60 uncompressed state) and release the brake pads 68 from contact with the dual tracks 32.

While the description above has been with respect to an embodiment wherein the roller carriage 18 comprises a respective brake mechanism 58 disposed on each side wall 40 thereof, it will be appreciated that the present disclosure is not meant to be so limited. Rather, in other exemplary embodiments, the roller carriage 18 may comprise a single brake mechanism 58 disposed on one side wall 40 or the other. Alternatively, the roller carriage 18 may comprise two or more mechanisms 58 disposed on one or both side walls 40 thereof Accordingly, it will be appreciated that embodiments other than those described with particularity herein remain within the spirit and scope of the present disclosure.

Figure 5:
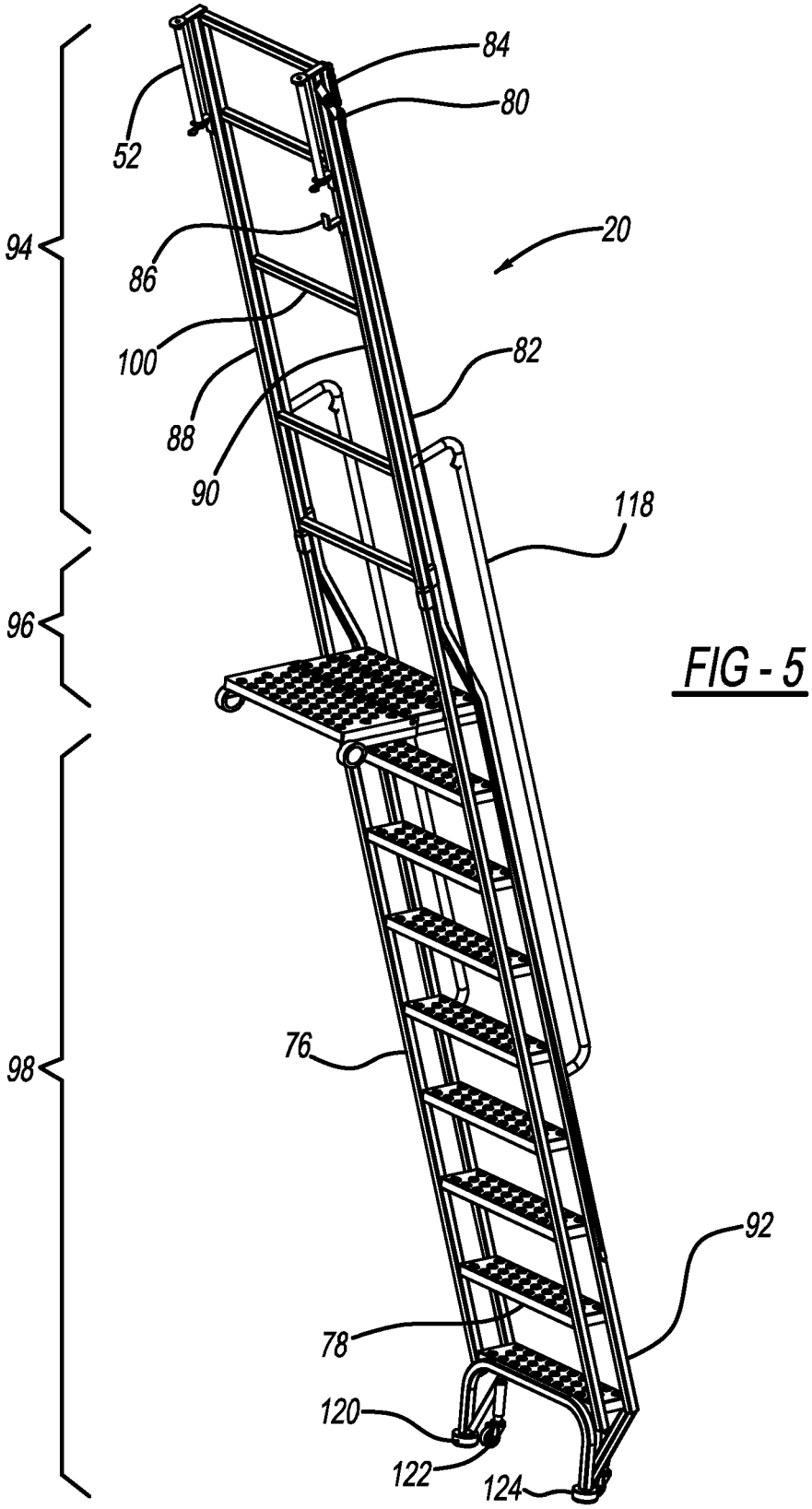
FIG. 5 is an isometric view of an embodiment of a ladder of the ladder assembly.

Referring to FIG. 5, the ladder assembly 14 includes a ladder 20. FIG. 5 generally illustrates an isometric view of an embodiment of the ladder 20. Additional reference will also be made to FIGS. 1, 2, and 3, which generally illustrates the ladder 20 as attached to the roller carriage 18 in either the operating position 30 or stored position 28.

In an embodiment, the ladder 20 comprises a frame 76, steps or stairs 78, a pair of sliding mechanisms 52 configured to engage the roller carriage 18, a latch 80, a cable 82 attached to the latch 80, a spring 84, and a retaining hook 86.

The frame 76 of the ladder 20 has a first side 88 and a second side 90 where each side 88, 90 comprises a pair of side rails 92 oriented substantially parallel to one another. An upper portion 94 of each of the first and second sides 88, 90 is configured such that the pair of side rails 92 thereof abut one another. Along a middle portion 96 of each of the first and second sides 88, 90, one of the side rails of the pair of side rails 92 flares out, creating a space between the pair of side rails 92. The spaced apart side rail arrangement extends therefrom through a lower portion 98 of the ladder 20. The lower portions 98 of the first and second sides 88, 90 are configured to support vertically spaced apart steps or stairs 78. The first and second sides 88, 90 of the frame are connected to one another by the steps 78 along the lower portion 98 and by a plurality of cross rails 100 laterally oriented along the upper portion 94 of the ladder 20.

The ladder 20 may also comprise a pair of hand rails 118, one located on each side of the ladder frame 76. The hand rails 118 of the ladder 20 are laterally spaced apart and parallel to one another and are carried by the frame 76 of the ladder 20. The hand rails 118 are configured to provide a grip for a person climbing the ladder steps or stairs 78.

The ladder may also comprise a lower stop or brake mechanism 120. More particularly, the lower portion 98 of the ladder 20 is provided with a pair of stop or brake mechanisms 120 comprising a pair of spaced apart spring-loaded casters 122 and a pair of rubber pads 124 which are carried by the bottom ends of a U-shaped support which is secured to the ladder frame 76. When the ladder 20 is not in use in the operating position 30, the spring-loaded casters or wheels 122 are designed to roll along the floor, with the bumpers 124 raised and spaced from the floor. When a person steps on a step 78 of the ladder 20 (or equivalent downward force is directed onto the ladder 20) the springs within the caster wheels 122 are compressed, thereby lowering the rubber pads 124 of the ladder 20 onto the floor to prevent movement of the ladder 20 at the bottom thereof When the ladder 20 is in the stored position 28, the caster wheels 122 stay engaged with the ground to allow the ladder 20 to be rolled against the wall 38. The rubber pads 124 locate the ladder 20 in the stored position 28 when the rubber pads 124 contact the wall 38.

Figure 6:
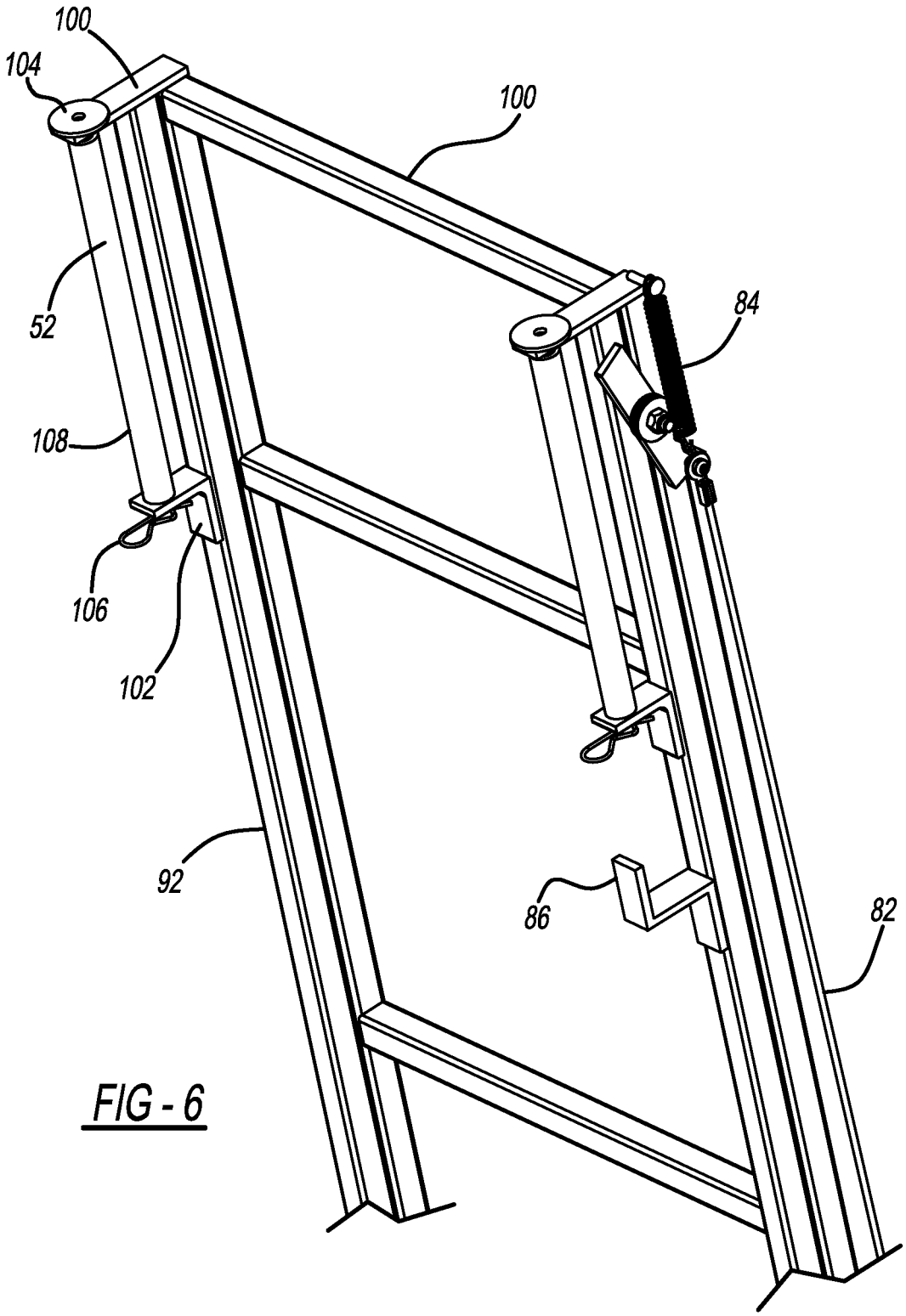
FIG. 6 is a partial enlarged isometric view of an upper portion of the ladder of FIG. 5.

FIG. 6 generally illustrates an enlarged view of the upper portion 94 of the ladder 20 of FIG. 5. In an embodiment, the upper portion 94 of the ladder 20 includes a pair of sliding mechanisms 52 configured to pivotally and slidably connect the ladder 20 to the roller carriage 18 and to the mounting bar 48 thereof, in particular. The pair of sliding mechanisms 52 allows the ladder 20 to pivot and slide along a slot of each sliding mechanism 52 relative to the mounting bar 48 (comprising at least one of the support rods 42) of the roller carriage 18. The first side and the second side 88, 90 of the ladder 20 each have a sliding mechanism 52. Each sliding mechanism 52 comprises an upper sliding bracket 100, a lower sliding bracket 102, a mounting rod 104, and a retaining pin 106. In an exemplary embodiment, each sliding mechanism may further comprise a mounting rod guard 108.

The upper sliding bracket 100 of each sliding mechanism is attached to one or more corresponding side rails 92 of the frame 76 of the ladder 20 and may be positioned where the upper sliding bracket 100 covers the ends of the side rail(s) 92. The upper sliding bracket 100 may be generally rectangular in shape and has an aperture therein near an end of the bracket 100 configured to allow a shaft of the mounting rod 104 to slide therethrough. The lower sliding bracket 102 is also attached to the one or more corresponding side rails 92 and may be positioned along a side surface of the side rail(s) 92. The lower sliding bracket 102 may be generally L-shaped in cross section and has an aperture therein near an end of the bracket 102 configured to allow the shaft of the mounting rod 104 to slide therethrough.

Each mounting rod 104 of the sliding mechanisms 52 comprises a shaft and a flange. The shaft of the mounting rod 104 is configured to slide through the apertures of the respective upper and lower sliding brackets 100, 102 and, in an exemplary embodiment, through a hollow portion of the corresponding mounting rod guard 108. The flange located at an end of the mounting rod 104 prevents the mounting rod 104 from completely sliding through the apertures of the upper and lower sliding brackets 100, 102. The other end of the shaft may have an aperture configured to engage a retaining pin 106. When the retaining pin 106 is attached to the mounting rod 104, the mounting rod 104 and mounting rod guard 108 are removably secured in a position relative to the side rails 92. In an exemplary embodiment, the retaining pin 106 may be a cotter pin design. While the present disclosure describes a particular embodiment of the retaining pin 106, the present disclosure is not meant to be so limited. Rather, in other exemplary embodiments, other types of retaining devices may be used as known to those having ordinary skill in the art. Accordingly, it will be appreciated that embodiments other than those described with particularity herein remain within the spirit and scope of the present disclosure.

As briefly described above, each sliding mechanism 52 may further comprise mounting rod guard 108. Each mounting rod guard 108 is hollow and may be substantially cylindrical in shape. Each the mounting rod guard 108 is secured in place via the mounting rod 104 sliding through the hollow portion of the mounting rod guard 108 and the mounting rod guard 108 is positioned between the respective upper and lower sliding brackets 100, 102. The mounting rod guard 108 is oriented substantially parallel to the surface of the side rail 92. Each mounting rod guard 108 creates a substantially uniform slot defined by the mounting rod guard 108, the surface of the side rail 92, and the upper and lower sliding brackets 100, 102. Each slot is configured to allow the mounting bar 48 of the roller carriage 18 to pivot and slide within the slot. The mounting rod guard 108 may be constructed of various materials to reduce friction between the mounting bar 48 of the roller carriage 18 and the sliding mechanism 52. In an exemplary embodiment, the mounting rod guard 108 material may be plastic, such as PVC; it will be appreciated, however, that any number of materials that reduce friction may also be used.

Figure 7:
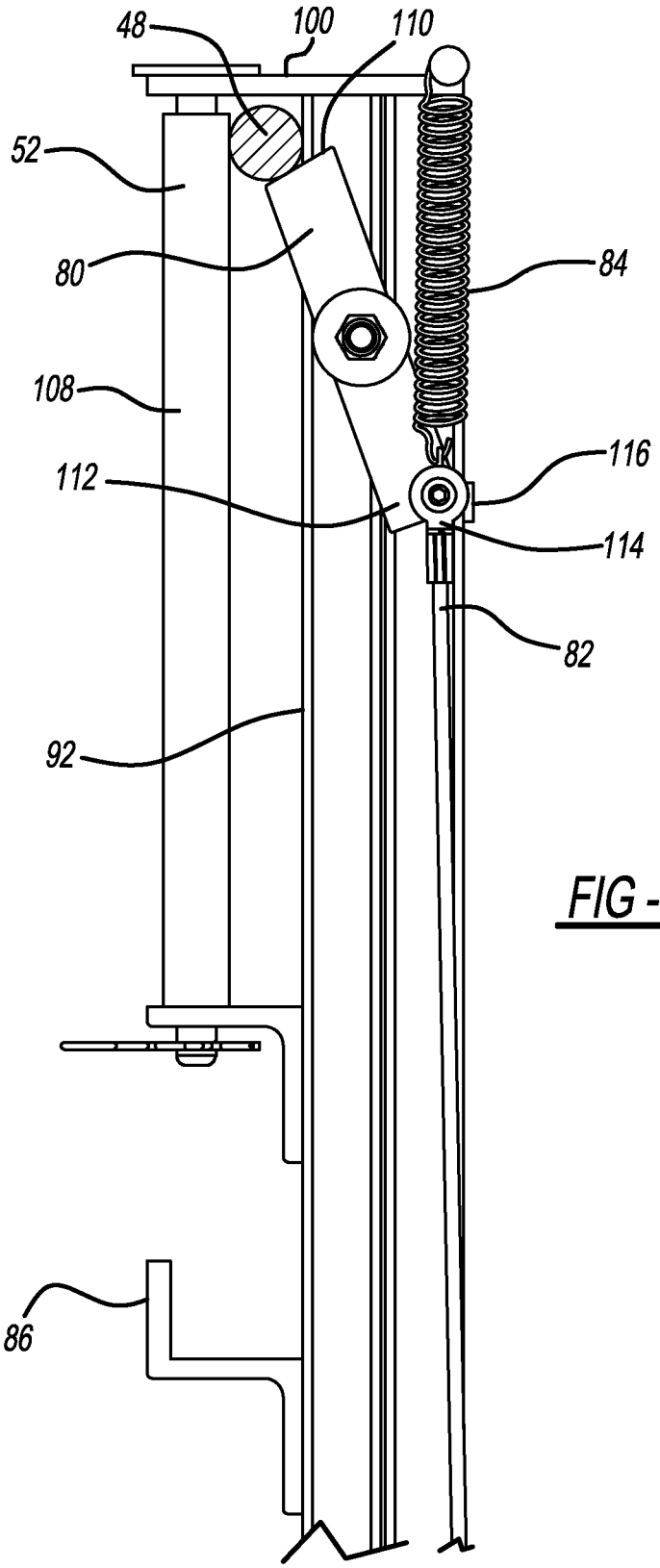
FIG. 7 is a partial side view of the upper portion of the ladder of FIG. 5.

FIG. 7 generally illustrates a side view of the upper portion 94 of the ladder 20. The ladder 20 has a pivoting latch 80 configured, as will be described in greater detail below, to prevent the ladder 20 from moving to a vertical position during climbing. The latch 80 may be substantially rectangular in shape. The latch 80 has a first end 110 and a second end 112 and is pivotally connected to a surface of a side rail 92 of the ladder frame 76. The first end 110 of the latch 80 is configured to securely position the mounting bar 48 of the roller carriage 18 in a top portion of the sliding mechanism 52 slot. The top portion of the sliding mechanism is defined by the mounting rod guard 108, the surface of the side rail 92, the upper sliding bracket 100 and the first end 110 of the latch 80.

The second end 112 of the latch 80 is connected to a first end 114 of a cable 82. The cable 82 runs along the frame 76 of the ladder 20 such than an operator can pull on the cable while the operator is standing on the ground. The opposing end of the cable 82 may be secured to ladder 20. The cable 82 may be brightly colored for visibility purposes. When the cable 82 is pulled, the first end 110 of the latch 80 will move or pivot away from the slot of the sliding mechanism 52, allowing the mounting bar 48 of the roller carriage 18 to freely move in the slot. The release of the mounting bar 48 of the roller carriage 18 allows the ladder 20 to move to a vertical storage position 28.

The second end 112 of the latch 80 is also connected to an end of a tension spring 84. The spring 84 is configured to bias the latch in a locking position that securely positions the mounting bar 48 of the roller carriage 18 in a top portion of the sliding mechanism 52 slot. The tension of the spring 84 may be overcome by pulling the cable 82 and moving the first end 110 of the latch 80 to an unlocked position. When the operator releases the cable 82, the tension of the spring 84 will return the first end 110 of the latch 80 back to the locked position. The locking position is located when the second end 112 of the latch 80 contacts a pivot stop 116 attached to the side rail 92.

The ladder 20 may have a generally S-shaped retaining hook 86 (in cross section) located near the top portion 94 of the ladder 20. When the ladder 20 is moved to the stored position 28, the hook 86 is configured to automatically mate and engage a loop attached directly or indirectly to the wall. As the ladder 20 is moved into the stored position 28 in a substantially vertical orientation, the engagement of the hook 86 on the ladder 20 to the loop on the wall secures the ladder 20 in the stored position 28 and prevents the top of the ladder 20 from moving away from the wall 38 via movement of the roller carriage 18 (e.g., the combination of the hook and loop prevent the longitudinal movement of the roller carriage 18).

Figure 8:
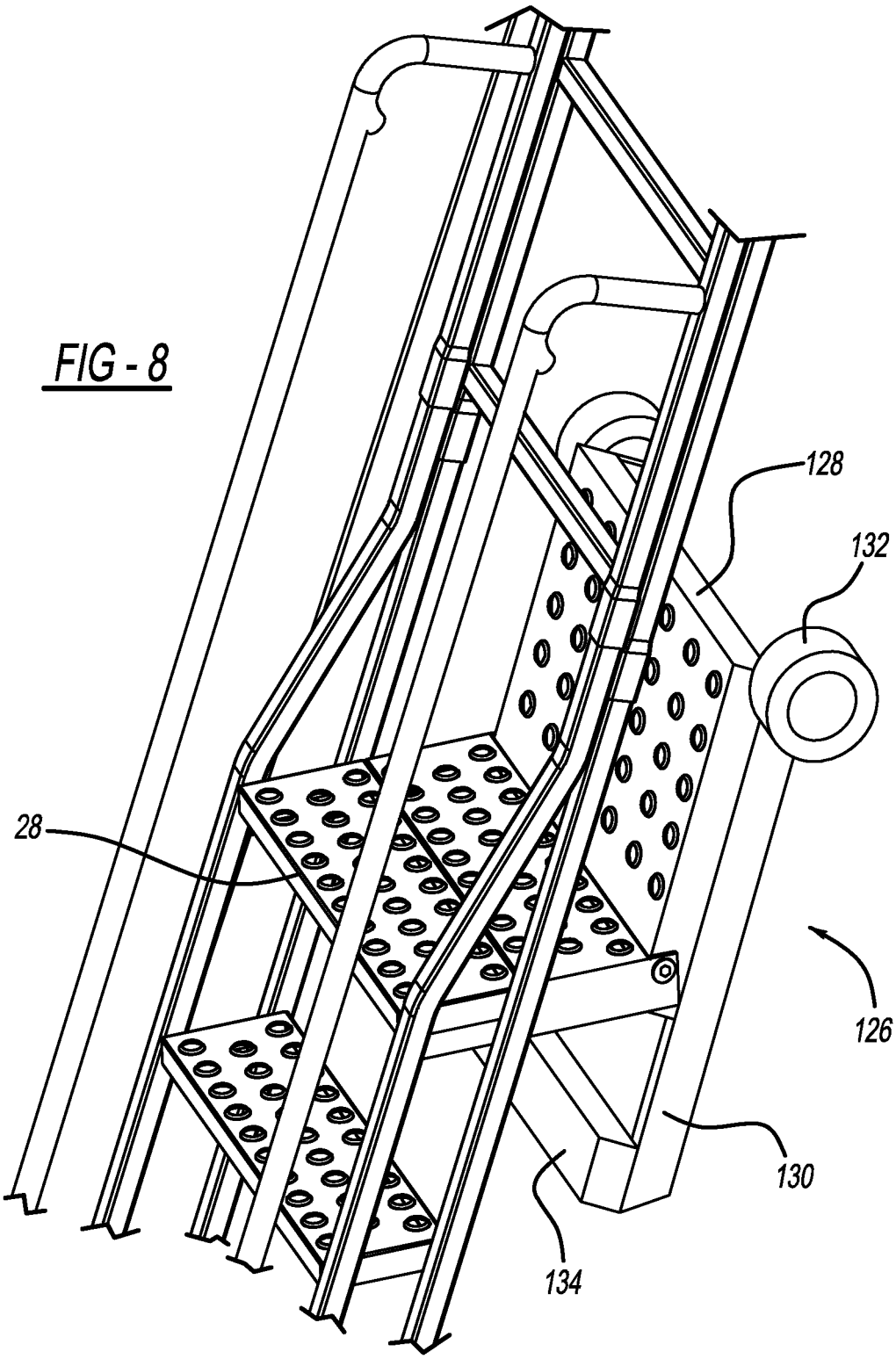
FIG. 8 is a partial isometric view of an embodiment of a folding platform of the ladder assembly.

FIG. 8 generally illustrates an isometric view of a folding platform 126 of the ladder 20 shown in the up position. In an exemplary embodiment, the folding platform 126 may have an up position and a down position (the down position is generally illustrated in FIG. 5). In an exemplary embodiment, the folding platform 126 is located proximate the top step 78 of the ladder 20. The folding platform 126 is configured to provide clearance such that the ladder 20 may be placed substantially vertical while in the stored position 28, and also to provide more than double the overall horizontal size of the top step 28 when an operator is standing on the platform 126. The folding platform 126 comprises a pivoting step 128, a pair of arms 130, and a pair of wheels 132.

The pivoting step 128 of the folding platform 130 may be pivotally connected to a pair of flanges protruding from a step 28 of the ladder 20, such as, for example and without limitation, the top step 28 of the ladder 20. A pair of longitudinally positioned arms 130 are attached to a first side and second side of the pivoting step 128. In an exemplary embodiment, the arms 130 may have an L-shaped cross section. While a detailed example regarding the shape of the arms 130 has been provided, other shapes may be used as known to those having ordinary skill in the art. A first end of each arm 130 extends beyond the upper surface of the pivoting step 128 to a length approximately equal to the longitudinal width of the top step 28. In an exemplary embodiment, the first end of each arm 130 may be connected to a counterweight 134. The second end of each arm 130 is connected to a respective wheel 132. The wheels 132 may contact the wall 38 when the ladder 20 is moved to a substantially vertical position, or in other words, the ladder's stored position 28 against the wall 38. If the wheels 132 contact the wall 38, the folding platform 128 will move into the up position.

In an exemplary embodiment, the folding platform may further comprise a counterweight 134. The counterweight 134 may be attached to the first ends of the arms 130. The counterweight 134 applies a downward force and pivots the pivoting step 128 located on the other side of the pivot point in the up position. The pivoting step 128 remains in the up position until a greater force applied to the top surface of the pivoting step 128 offsets the force of the counterweight 134, such as the weight of an operator standing on the pivoting step 128. When the pivoting step 128 is forced into the down position, the counterweight 134 is rotated toward a bottom surface of the top step 28 until the counterweight 134 engages the top step 28. Upon engagement of the top step 28 with the counterweight 134, the counterweight 134 and arms 130 stop the pivoting step 128 from further rotating and positions the pivoting step 128 where an upper surface of the pivoting step 128 is substantially coplanar with an upper surface of the top step 28. In an exemplary embodiment, the counterweight 134 may comprise a substantially rectangular shape and the counterweight 134 material may be made of metal. While a detailed example regarding the shape and material of the counterweight 134 has been provided, other shapes and materials may be used as known to those having ordinary skill in the art. While an exemplary embodiment of the folding platform 126 further comprising a counterweight 134 is disclosed, it will be appreciated that use of the counterweight 134 with the folding platform 126 is optional.

The present disclosure includes a way to mechanically move the ladder 20 of a ladder assembly 14 to a stored position 28 against a wall 38 to provide clearance with respect to the movable shelving 12 to allow the shelves to be moved unimpeded by the ladder 20. To position the ladder 20 in the stored position 28, the ladder 20 may be moved longitudinally by pushing the ladder 20 toward the wall 38 (or an area past an end of the mobile shelving 12). When the roller carriage 18 engages the end of the overhead track system 16, the roller carriage 18, and therefore the ladder 20 mounted thereto, will no longer move longitudinally toward the wall 38. To move the ladder 20 to a stored position 28, the operator must pull on the cable 82 which moves the latch 80 to the unlocked position. While the latch 80 is in the unlocked position, the ladder 20 may be pushed longitudinally toward the wall 38. Pushing the ladder 20 toward the wall 38 causes the upper portion 94 of the ladder 20 to move in an upward direction. As the ladder 20 moves in an upward direction, the mounting bar 48 of the roller carriage 18 moves along the slots of the sliding mechanisms 52 in a downward direction and clears the latch 80. After the mounting bar 48 of the roller carriage 18 clears the latch 80, the operator may release the cable 82 and the latch 80 returns to the locked position. When the ladder 20 becomes substantially vertically oriented, the retaining hook 86 will engage the mating loop located on the wall 38, the wheels 132 of the folding platform 126 will keep the pivoting step 128 in the up position, and the rubber pads 124 on the lower portion 98 of the ladder 20 will contact the wall 38. The ladder assembly 14 will remain positioned against the wall 38 until, as will be described more fully below, a user/operator moves the ladder 20 longitudinally away from the wall 38. When the ladder 20 is in the store position 28, the shelves of the shelving bank 12 may be moved unimpeded by the ladder 20 to create access to different shelves by creating a new aisle 26.

To position the ladder 20 in the operating position, the operator must pull the ladder 20 longitudinally away from the wall. The ladder 20 will start to pivot and angle away from the wall 38, starting from the lower portion 98 of the ladder 20. While the ladder 20 is pivoting and angling away from the wall 38, the upper portion 94 of the ladder 20 will slide downward. As the ladder 20 angles away from the wall 38 and the top portion 94 of the ladder 20 slides downward, the retaining hook 86 will disengage from the mating loop on the wall 38 which allows the roller carriage 18 freedom to move longitudinally along the overhead track assembly 16. The mounting bar 48 of the roller carriage 18 will move upward in the slots of the sliding mechanisms 52 until it hits the upper sliding brackets 100 of the sliding mechanisms 52. The latch 80 will automatically lock the mounting bar 48 of the roller carriage 18 into position (i.e., the latch 80 will capture or retain the mounting bar 48 within an upper portion of the slots). The ladder assembly 14 is then in the operating position 30 and may be translated longitudinally in the aisle 26 of the mobile shelving bank 12.

Although certain exemplary embodiments have been described above with a certain degree of particularity, those skilled in the art could make numerous alterations to the disclosed embodiments without departing from the scope of this disclosure. Additionally, all directional references (e.g., up, down, left, right, longitudinally, laterally) are only used for identification purposes to aid the reader's understanding of the present disclosure, and do not create limitations, particularly as to the position, orientation, or use of the invention. Joinder references (e.g., attached, bonded, connected, and the like) are to be construed broadly and may include intermediate members between a connection of elements and relative movement between elements. As such, joinder references do not necessarily infer that two elements are directly connected/coupled and in fixed relation to each other. It is intended that all matter contained in the above description or shown in the accompanying drawings shall be interpreted as illustrative only and not limiting. Changes in detail or structure may be made without departing from the invention as defined in the appended claims.

What is claimed is:

1. A ladder assembly for use with movable shelving, said ladder assembly comprising:

an overhead track assembly including a first guide track and a second guide track;

a carriage operatively configured to move longitudinally along said first and second guide tracks, said carriage having a first side wall, a second side wall, and a support rod extending in a first, lateral direction between said first side wall and said second side wall; and a ladder pivotally and slidably mounted to said carriage, said ladder being slidably mounted to said carriage so as to allow said ladder to slidably move relative to said carriage in a second direction substantially perpendicular to said first, lateral direction, said ladder having an operating position wherein said ladder in the operating position is located in an aisle of the movable shelving, said ladder being slidably movable away from said operating position to a stored position wherein said ladder in the stored position is located substantially vertical and outside of the aisle of the movable shelving; and wherein said ladder has a sliding mechanism including a slot, said carriage comprising a mounting bar that includes at least said support rod of said carriage wherein said mounting bar is disposed in and confined to move within said slot, and wherein said sliding mechanism has a removable mounting rod mounted to and offset from said ladder by an upper sliding bracket and a lower sliding bracket, wherein said mounting rod is configured to removably connect said support rod of said carriage to said sliding mechanism; and wherein a shaft of said mounting rod is substantially covered by a mounting rod guard configured to provide a wear surface, said slot being defined by said mounting rod guard and said upper and lower sliding brackets.

2. The ladder assembly of claim 1, wherein said overhead track assembly is located at a height greater than the height of the movable shelving.

3. The ladder assembly of claim 1, wherein said ladder further comprises a retaining hook configured to engage a corresponding mating loop when said ladder is in the stored position.

4. The ladder assembly of claim 1, wherein said ladder further comprises a latch configured to lock said ladder in the operating position.

5. The ladder assembly of claim 4, wherein said latch is biased in a locked position via a spring.

6. The ladder assembly of claim 4, wherein said latch is moved to an unlocked position via a cable configured to be operable from a lower portion of said ladder.

7. The ladder assembly of claim 1, wherein said ladder further comprises a platform configured to pivotally fold when said ladder is in the stored position.

* * * * *

UNITED STATES PATENT AND TRADEMARK OFFICE

CERTIFICATE OF CORRECTION

PATENT NO. : 9,051,779 B2
APPLICATION NO. : 13/669869
DATED : June 9, 2015
INVENTOR(S) : James F. Kerr It is certified that error appears in the above-identified patent and that said Letters Patent is hereby corrected as shown below:

In the Claims

Claim 5, column 12, line 9, delete "biased in a" and insert --biased into a--.

Signed and Sealed this
Twentieth Day of October, 2015

Michelle K. Lee

Michelle K. Lee
*Director of the United States Patent and Trademark Office*